United States Patent [19]

Prandin

[11] Patent Number: 4,642,952

[45] Date of Patent: Feb. 17, 1987

[54] A-SHELTER

[76] Inventor: Otello Prandin, Via Guanzasca 24, Fino Mornasco Como, Italy

[21] Appl. No.: 700,266

[22] Filed: Feb. 11, 1985

[30] Foreign Application Priority Data

Feb. 23, 1984 [IT] Italy ..... 19752 A/84

[51] Int. Cl.[4] ..... E02D 27/00

[52] U.S. Cl. ..... 52/169.6; 52/86; 109/1 S

[58] Field of Search ..... 52/169.6, 86, 82; 109/1 S

[56] References Cited

U.S. PATENT DOCUMENTS 3,049,835 8/1962 Sundstrum ..... 52/169.6

FOREIGN PATENT DOCUMENTS 504642 4/1939 United Kingdom ..... 52/169.6

*Primary Examiner*—Carl D. Friedman

*Attorney, Agent, or Firm*—Stevens, Davis, Miller & Mosher

[57] ABSTRACT

A nuclear bomb shelter of small dimensions, buildable at low-cost and of very easily installable prefabricated structural elements, comprising an outer protective wall of cupola shape, an optional second inner wall, concentric to the first wall, and bounding a central living compartment and an air space between the two walls, suitable to house various utilities and accessories, it being possible to make the prefabricated elements e.g. of plastic material.

3 Claims, 4 Drawing Figures

A-SHELTER

The object of the present invention is a nuclear bomb shelter of dimensions suitable to accomodate a limited number of people, of the order of 4 or 5, realized with prefabricated structural elements, whose installation is very simple and cheap.

Such nuclear bomb shelters provided up to this date, of the "single-family" type are substantially constituted by an underground room, with walls of reinforced concrete, having a parallelepipedon shape, and having hence a ceiling consisting of a flat, horizontal concrete slab. Such a structure requires large wall thicknesses, in order to secure a good resistance to the pressure exerted by the shock waves caused by an atomic explosure, besides guaranteeing the necessary tightness for the protection against the infiltrations of radioactive material.

The cost of such a type of construction is consequently necessarily very high.

Purpose of the present invention is to provide a nuclear bomb shelter formed by prefabricated structural elements, and so shaped as to guarantee optimum characteristics of resistance and of tightness, by using the minimum amount of materials, and a low costs.

The nuclear bomb shelter according to the present invention is placed underground, at a depth sufficient for not suffering the effects of the explosion, which take place at the surface of the ground, and is constituted by a room provided with a roof with curvilinear profile, directly resting on the base floor of the room, said curvilinear roof being suitable to offer the highest resistance of the structure to the stresses due to the weight of the soil resting on it, as well as to the shock waves transmitted by the ground itself, and caused by an atomic explosion, or also by natural telluric movements.

A type of roof particularly suitable to this purpose is the type of cupola shape with circular or polygonal plan, or the type with barrel vault (tunnel).

DESCRIPTION OF A PREFERRED EMBODIMENT

Figure 1:
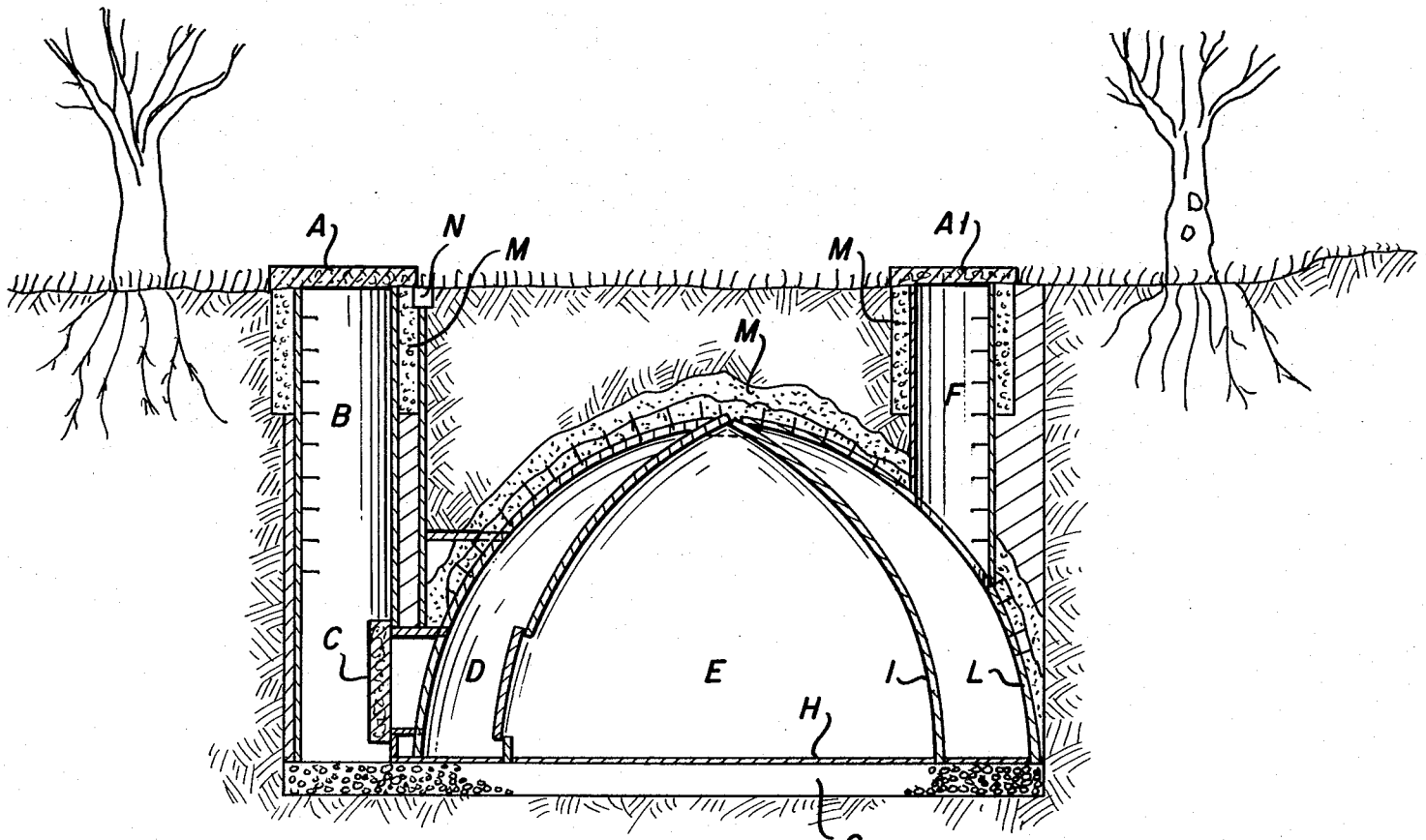
FIG. 1 is an elevational cross sectional view of the nuclear bomb shelter of the present invention showing it in place in a subterranean installation.
Figure 2:
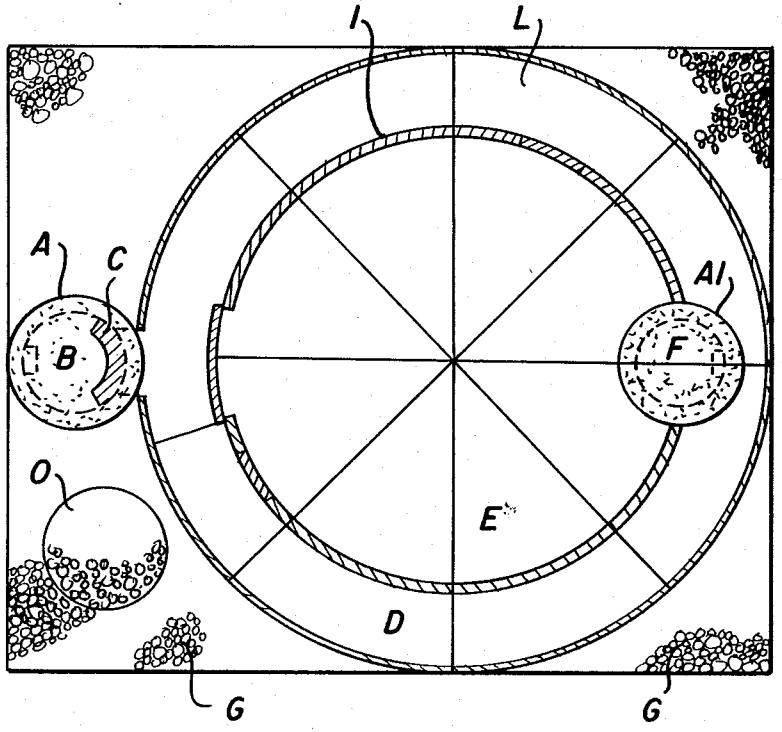
FIG. 2 is a top plan view of the shelter of FIG. 1 with part of the surrounding earth removed.

A typical embodiment of the A-shelter according to the invention comprises the following essential parts:

(1) Outer wall L having a cupola shape with circular or polygonal base, with preferably ogival or parabolic profile, constituted by prefabricated elements of spherical sector shape, shown in plan in FIG. 2 and in cross section in FIG. 1, made of a suitable material, e.g., of metal, or of plastic material, or of concrete or of synthetic resin, provided with suitable reinforcing elements (ribs), suitable to be easily connected to each other, and to be fastened at their base on the floor H. In the outer wall metallic inserts may be provided, intended to anchor inside the outer concrete coat M.

(2) Inner wall I, it too having a cupola shape of circular or polygonal base, preferably with parabolic or ogival profile, bounding the central living room E, forming, together with the outer wall, an air space of crown shape, used for various services.

The inner wall at its upper end is an integral part of the outer wall, thus contributing in the solidity of the outer structure, and is constituted by prefabricated elements, having the shape of spherical sectors, shown in plan in FIG. 2, and in cross section in FIG. 1, made of a suitable material, e.g., of metal, or of plastic material, or of concrete or of synthetic resin, provided with optional reinforcing elements (ribs), suitable to be easily connected to each other, and to be anchored at the base on floor H.

(3) Floor of the room H, preferably of plastic material, provided with fastening elements, e.g. of the dap type, of the bases of the elements of spherical sector shape described under the preceding points (1) and (2).

The floor may be of the folding type structure, or it may be formed by several pieces, e.g. of spherical sector shape, which may be easily installed and connected to each other. Such a floor rests on a suitable permeable bottom consisting of a pebble layer G.

(4) Entrance shaft B of preferably tubular shape, constituted by a single reinforced concrete element, or by a plurality of superimposed tubular elements, made of concrete, metal, or other suitable material. It is provided, in correspondence of the outer entry, with a tightly sealable and very strong door A, preferably made with an outer part of metal, and an inner part of concrete. A second safety door C connects the access shaft with the circular air space D: also this door is very strong and of large thickness, it can be of the vertical rolling gate type.

(5) Emergency exit F, provided at ground level with a tightly sealable door A.1.

The A-shelter according to the invention is provided with accessory utilities similarly to the shelters of the presently known art, such as the shower, sanitary services, ventilating system with outer air intake N (see FIG. 1) provided with filtering element, electric energy generator, absorbing well O, and so on, which can partly be suitable positioned within the air space D.

A nuclear bomb shelter made according to the outline and the principles hereinabove disclosed and illustrated in FIGS. 1 and 2, having a diameter of the outer cupola of 5 meters, can shelter up to 5 people.

The nuclear bomb shelter according to the invention may be made with a single cupola wall. In that case, the entrance shaft will also be used as antechamber and will be suitably provided with a shower.

The nuclear bomb shelter according to the invention may be made with prefabricated elements at limited manufacturing costs, and the installation manpower requirements are moreover minimum, and within the reach of anybody.

The overall cost of a nuclear bomb shelter according to the invention may be of the order of a quarter of the cost of a concrete shelter according to the presently known art. The prefabricated elements for building the shelter according to the invention may possibly, depending on the material they are made of, be marketed packed as assembling kits.

Figure 3:
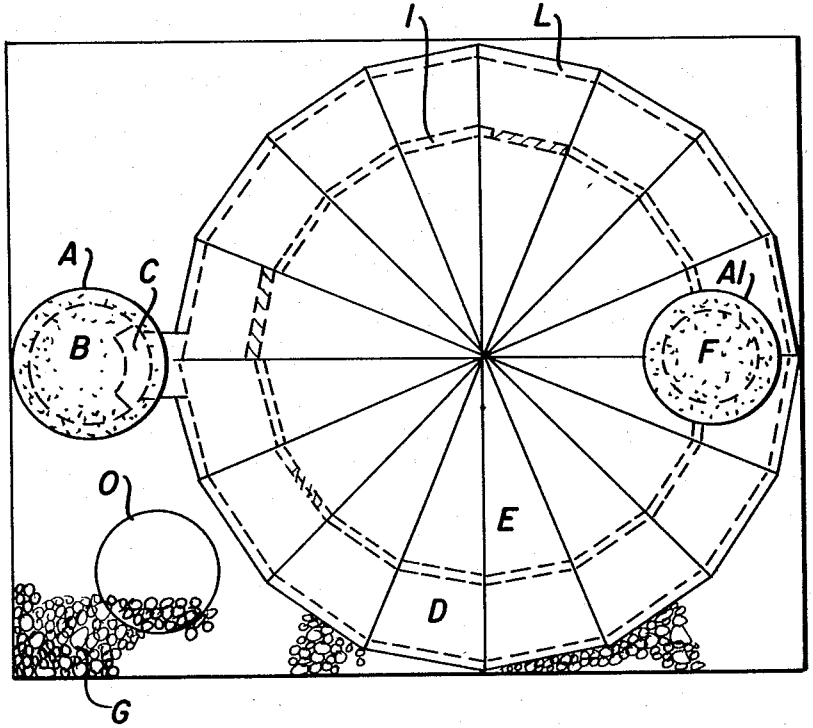
FIG. 3 is a top plan view of the shelter with a polygonal shape.

The shelter according to the invention may be realized with a plan of polygonal, instead of circular, shape, as shown in FIG. 3. In that case, the spherical sector elements constituting its structure will be suitably curved isosceles triangles.

Said triangular spherical sectors may also have a shaped surface, and their base side may be of not rectilinear shape.

Figure 4:
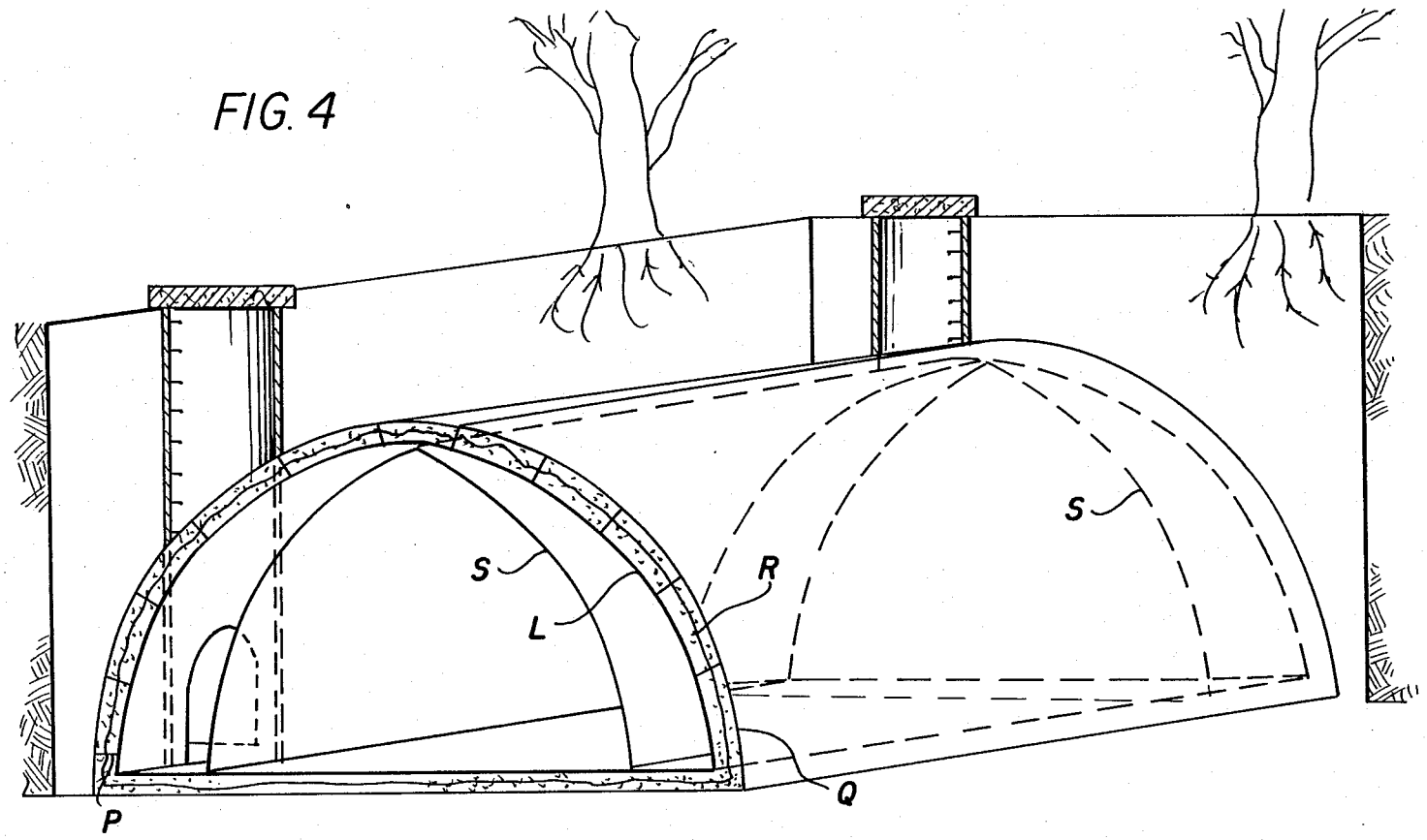
FIG. 4 is another embodiment of the invention, being of generally tunnel shape.

Another embodiment of the shelter according to the invention is that shown in FIG. 4, having a tunnel shape. In said figure are indicated: with L the curvilinear roof, with R a reinforcement air space for concrete casting, with P spacer elements, with Q an outer wall fastened by means of the spacer elements P and forming, together with the wall L, a formwork for concrete casting. With S a possible inner wall is indicated, not constituting an essential element of the structure, and which may serve to bound a peripheral portion of the room.

A building process particularly suitable to the building of the shelter according to the invention is precisely that using the roofing wall with curvilinear shape (cupola shape, tunnel shape, or similar shapes), suitably provided with spacer elements, in association with an outer wall parallel thereto, to form a formwork of the so-called "expendible" type for concrete casting: the curvilinearly shaped roofing wall will remain therefore comprised within the ultimate structure, and will be an essential and characteristic part thereof.

I claim:

1. A nuclear bomb shelter having a room with a roofing wall of curvilinear shape and directly resting on a floor for the room and comprising a plurality of prefabricated elements suitable to constitute a formwork for concrete casting, and having said room comprising the following essential parts:

(a) an outer wall of cupola shape with a circular or polygonal base with a parabolic or ogival profile, constituted by prefabricated elements of spherical sector shape provided with reinforcing elements, and means for connection to each other, and anchored at their base on a floor;

(b) an inner wall having the shape of a cupola with a circular or polygonal base, with parabolic or ogival profile, defining a central living space and an essentially crown-shaped air space located between said inner and outer walls, said inner wall at its top is in contact with and forms an integral part of the outer wall, said inner wall being constituted by prefabricated elements of spherical sector shape, connected to each other, and anchored at their base to the floor;

(c) said floor, preferably of plastic material, being prefabricated of detachable elements or of a folding type structure;

(d) an entrance shaft of tubular form, having a tightly sealable door at its outer entry, and having a safety door for communication with said air space or directly with the central living space; and (e) an emergency exit provided at ground level with a tightly sealable door.

2. The bomb shelter of claim 1 in which the floor is resting on a drainage layer comprising pebbles.

3. The bomb shelter of claim 1 in which the elements comprising the outer wall are provided on their outer face with metallic inserts, positioned to anchor inside a layer of concrete poured thereover.

* * * * *